US008636171B1

(12) United States Patent
Dattilo

(10) Patent No.: US 8,636,171 B1
(45) Date of Patent: Jan. 28, 2014

(54) DRIPLESS CONTAINER

(76) Inventor: Daniel Dattilo, New Port Richey, FL (US)

( * ) Notice: Subject to any disclaimer, the term of this patent is extended or adjusted under 35 U.S.C. 154(b) by 0 days.

(21) Appl. No.: 13/429,395

(22) Filed: Mar. 25, 2012

Related U.S. Application Data

(63) Continuation-in-part of application No. 13/344,705, filed on Jan. 6, 2012.

(51) Int. Cl.
*B65D 23/06* (2006.01)
*B65D 23/10* (2006.01)

(52) U.S. Cl.
USPC ..... 220/731; 220/695; 220/657

(58) Field of Classification Search
USPC ..... 220/695, 657, 731
See application file for complete search history.

(56) References Cited

U.S. PATENT DOCUMENTS

| | | | | | |
|---|---|---|---|---|---|
| 229,158 | A * | 6/1880 | Mander | 220/657 |
| 2,304,631 | A * | 12/1942 | Ensing | 4/450 |
| 2,461,549 | A * | 2/1949 | Jacobs | 250/462.1 |
| 2,627,367 | A * | 2/1953 | Bork | 222/570 |
| 4,832,225 | A * | 5/1989 | Benjamin | 220/254.1 |
| 4,927,046 | A | 5/1990 | Armstrong | |
| 5,004,882 | A * | 4/1991 | Nottingham et al. | 219/732 |
| 5,203,836 | A * | 4/1993 | Brazis et al. | 206/507 |
| 5,314,061 | A | 5/1994 | Bedrossian | |
| 5,549,216 | A | 8/1996 | Scholl | |
| 5,593,891 | A * | 1/1997 | Banes | 435/305.1 |
| 5,662,242 | A * | 9/1997 | Steo | 220/695 |
| 6,293,692 | B1 | 9/2001 | Bowsher | |
| 6,609,629 | B2 | 8/2003 | Lucey | |
| 7,275,666 | B2 * | 10/2007 | Rukavina et al. | 222/570 |
| 7,410,074 | B1 | 8/2008 | Brunning | |
| 7,428,977 | B2 | 9/2008 | Fera | |
| D634,907 | S | 3/2011 | Bergman | |
| 2007/0091718 | A1 * | 4/2007 | Browne et al. | 366/347 |
| 2007/0295768 | A1 * | 12/2007 | Gringer et al. | 222/570 |
| 2010/0176140 | A1 * | 7/2010 | Bergman | 220/754 |

* cited by examiner

*Primary Examiner* — Mickey Yu
*Assistant Examiner* — Niki Eloshway

(57) ABSTRACT

A container trapezoidal in shape for carrying liquids and loose materials. The body of container having an open top with opposite front and back side walls, opposite right and left side walls slanting inwards to a closed bottom. Three adjoining side walls having a flange at top rim angling down inside container forming an overhang. The edge of the flange is used to wipe excess liquid off of applicator. This excess paint drips into the container. The container includes a magnet for holding a brush, a convenient pouring spout and supportive handle.

1 Claim, 7 Drawing Sheets

DRIPLESS CONTAINER

BACKGROUND

This invention relates to containers used to transport a fluid for application to an object. More specifically to a paint bucket. When used for a period of time, excess paint accumulates on the rim of paint bucket from the continued wiping of an applicator. This paint then drips from the outer edge and runs down the exterior of the bucket. Also it can drip on the surface where then container is sitting, or drips while the bucket is being carried.

Most buckets have rounded edges. Wiping a flat side brush on a round edge leaves the brush with an uneven load of paint.

U.S. Pat. No. 6,609,629 Lucey discloses a container having an external gutter located below a primary wiping surface or edge. Drips from the wiping surface accumulate in the gutter and drain back into the container through drain holes at the bottom of the gutter. It has been noted that the drain holes in repeated use need to be cleaned periodically to avoid clogging. U.S. Pat. No. 7,428,977 Fera discloses a round container with a wiping lip spaced in board of rim and a support bracket is provided for suspending the lip in its in board position. Being a round container, this does not serve as well for the wiping of a loaded flat sided brush on its rim or edge. Both referred to patents do not have a pouring spout.

SUMMARY

Therefore it is an object of this invention to provide an improved dripless container.

Another object of this invention is to provide a container with a handle.

It is another object of this invention is to provide a container with a spout.

Another object of this invention is to provide a container in different sizes.

It is another object of this invention is to provide a container with improved shape for use with flat sided brush.

Another object of this invention is an improved container to result in a cleaner work area.

It is another object to provide a device to secure a tool.

Other objects and advantages of this invention will become apparent and obvious from a study of the following description and the accompanying drawings which are merely illustrative of such invention.

DRAWINGS

Reference Numerals

| | | | |
|---|---|---|---|
| 20 | dripless container | 23 | spout |
| 25 | handle | 27 | flange |
| 29 | rim | 31 | leading edge |
| 32 | top | 33 | front wall |
| 34 | bottom | 35 | back wall |

-continued

| | | | |
|---|---|---|---|
| 37 | left wall | 39 | right wall |
| 41 | metal handle | 43 | magnet |

DETAILED DESCRIPTION OF THE INVENTION

Figure 1:
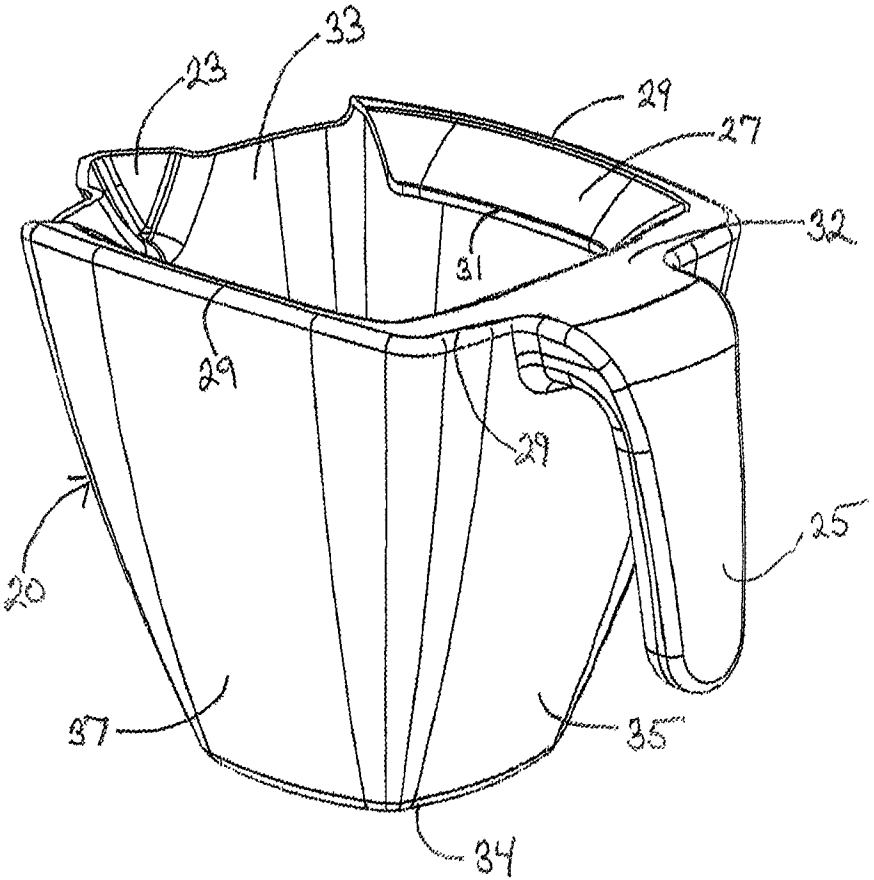
FIG. 1 is a side view of the container of the invention.

The dripless container 20 of the present invention depicted in FIG. 1 comprises a molded container 20, trapezoidal in shape with an open top 32, closed bottom 34, defining a cavity for carrying liquids and loose material.

The distinctive features of this container 20 in FIG. 1 are its convenient pouring spout 23, its flange 27 that overhangs at the top rim 29 with magnet 43 and handle 25.

The container 20 has opposite side front wall 33 and back wall 35, opposite side right wall 39 and left wall 37 slanting inwards to bottom 34.

Figure 2:
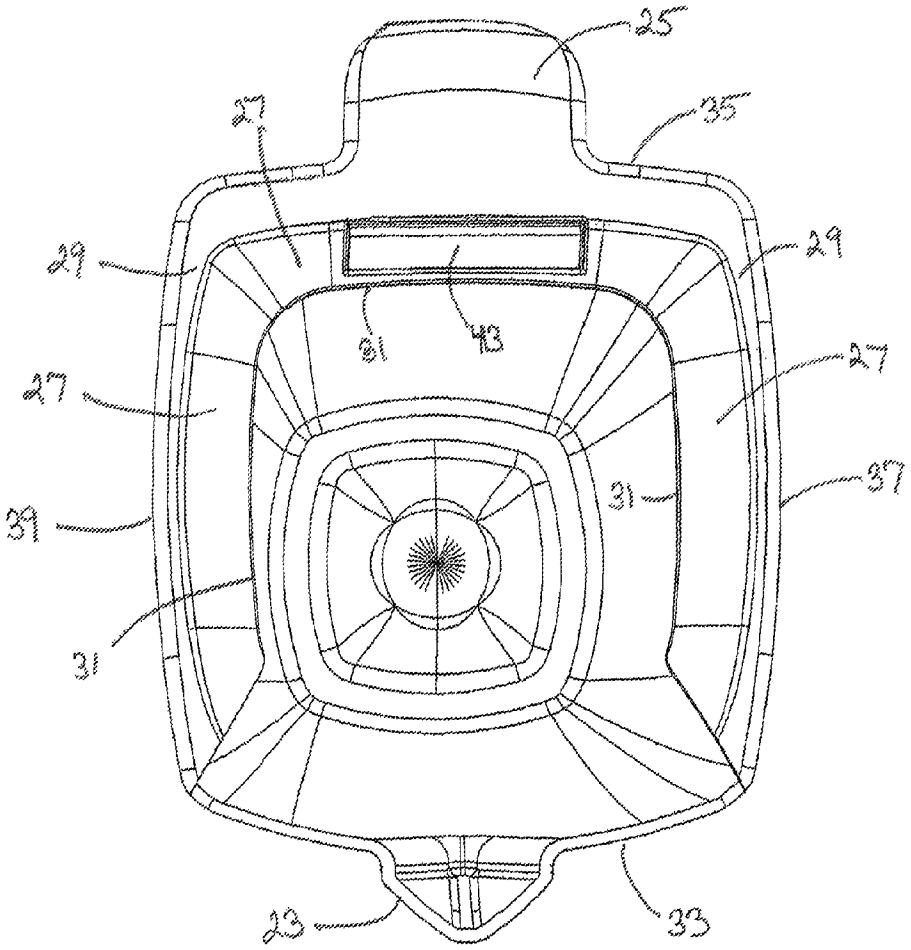
FIG. 2 is a top view of thereof.
Figure 3:
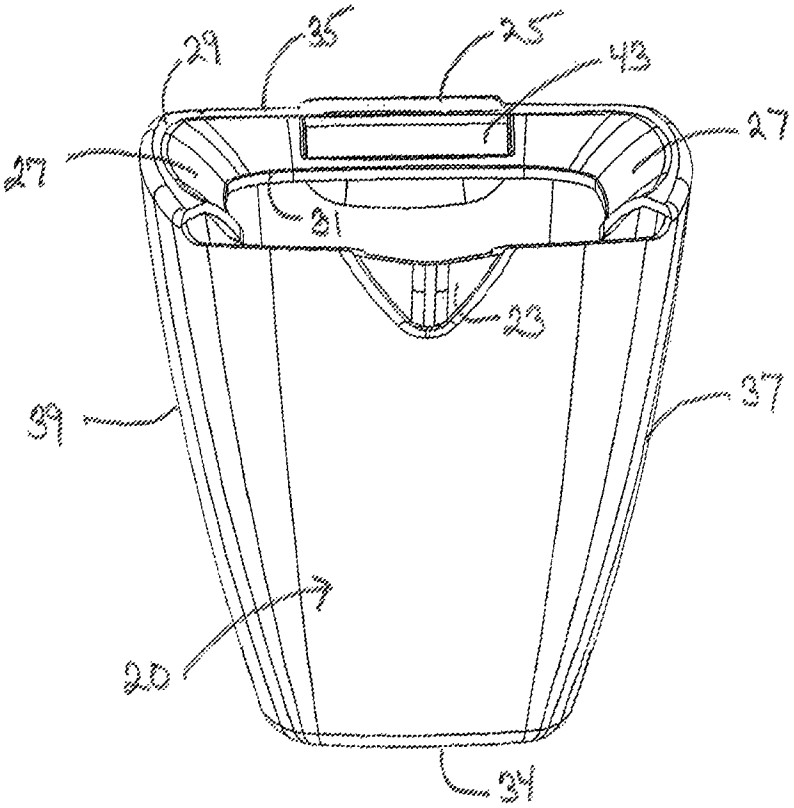
FIG. 3 is a front view of container.

FIG. 1 shows a contoured fitting handle 25 located on outside of back wall 35. The handle 25 provides a convenient and stable way to hold the container 20. The user can place his palm against the back side wall 35 by sliding his hand under handle 20 and letting container 20 rest on top of hand, allowing holding of container 20 for an extended period of time. The container 20 in FIG. 3 has a flange 27 overhanging at rim 29 of container 20 on left wall 37, opposite right wall 39 and back wall 35. The flange 27 is angled downwards to allow liquids to drip into container 20. FIG. 2 illustrates the leading edge 31 of the flange 27. When the applicator is dipped into the container 20 to load with liquid, it is then wiped against leading edge 31 to remove excess liquid. The excess liquid drips into the container 20 and leaves applicator with an even load of paint.

Figure 4:
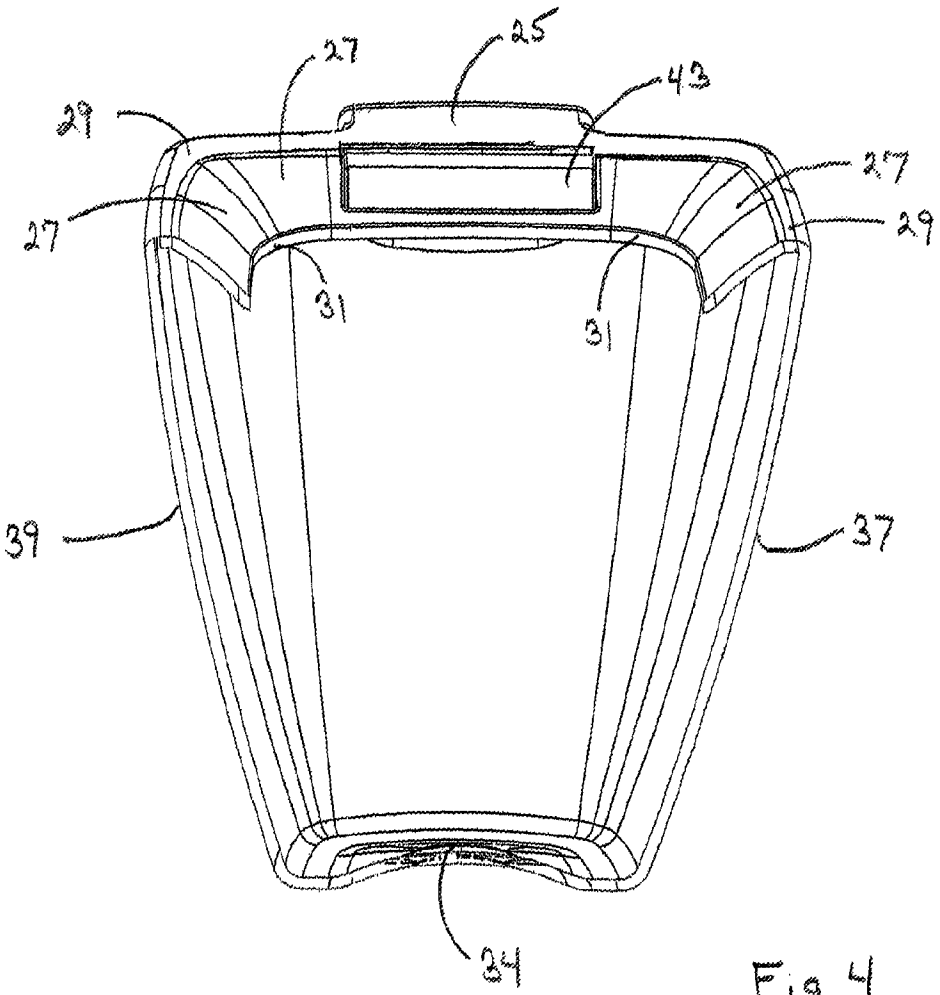
FIG. 4 is a front cross sectional view of container.

FIG. 4 shows a cross sectional view of the flange 27 angled downwards. The flange 27 has a recessed magnet 43, which is flush with the top surface of flange 27 to hold a paint brush. This allows the brush to overhang the cavity of container 20 at the same angle as the flange 27, which allows excess paint to drip into container 20.

Figure 5:
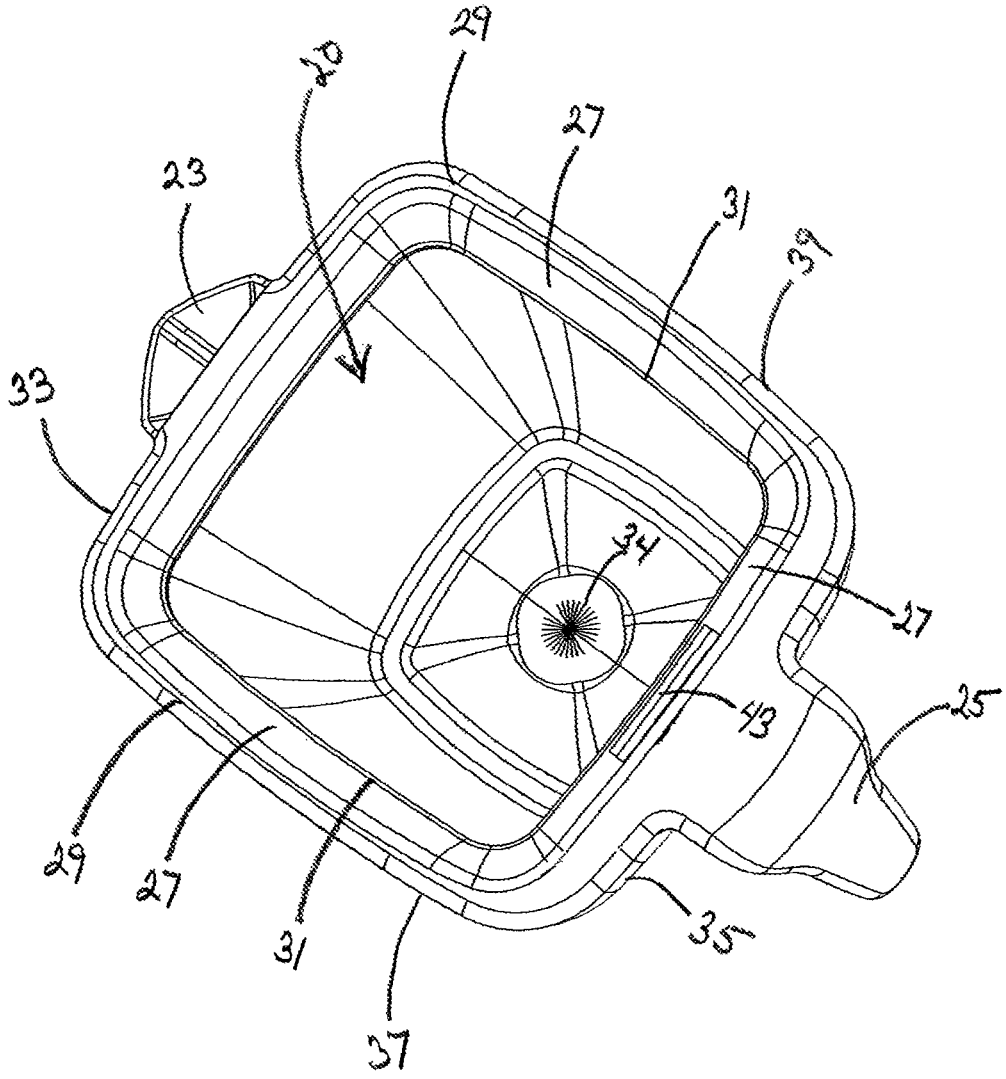
FIG. 5 is an additional top view of container.

FIG. 5 shows an embodiment of the container 20 with a flange 27 around the entire rim of container which allows additional surface to wipe off excess liquid from applicator.

Figure 6:
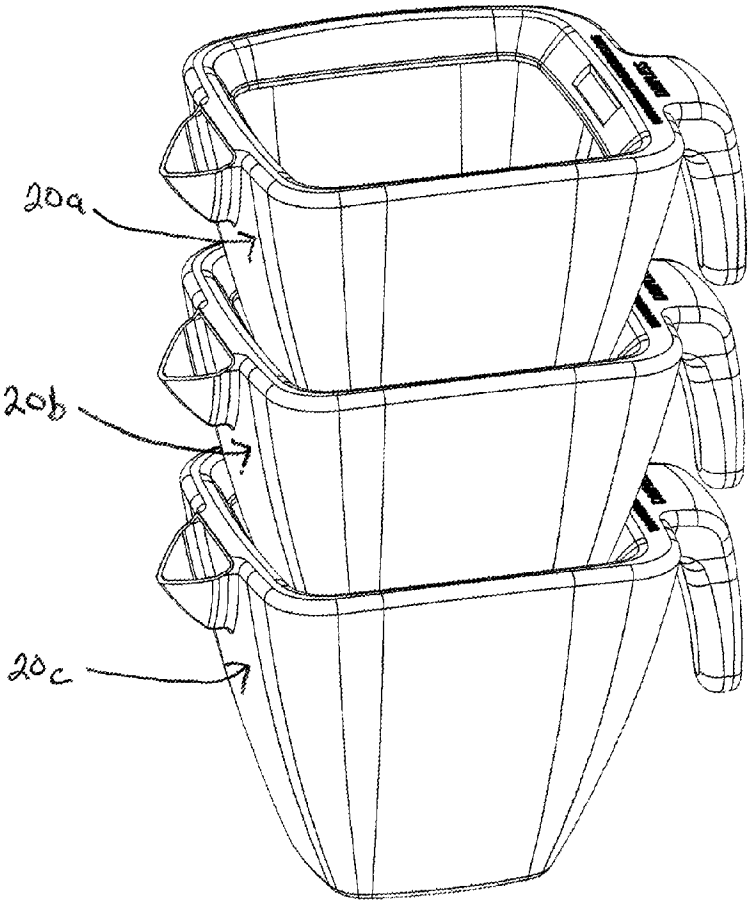
FIG. 6 is a side view of multiple stacked containers.

In FIG. 6 the shape of the containers 20*a*, 20*b*, and 20*c* are sized to allow stacking of multiple containers 20 for retail display. This allows for large quantities to take up minimal space when shipped and shelved in stores.

Figure 7:
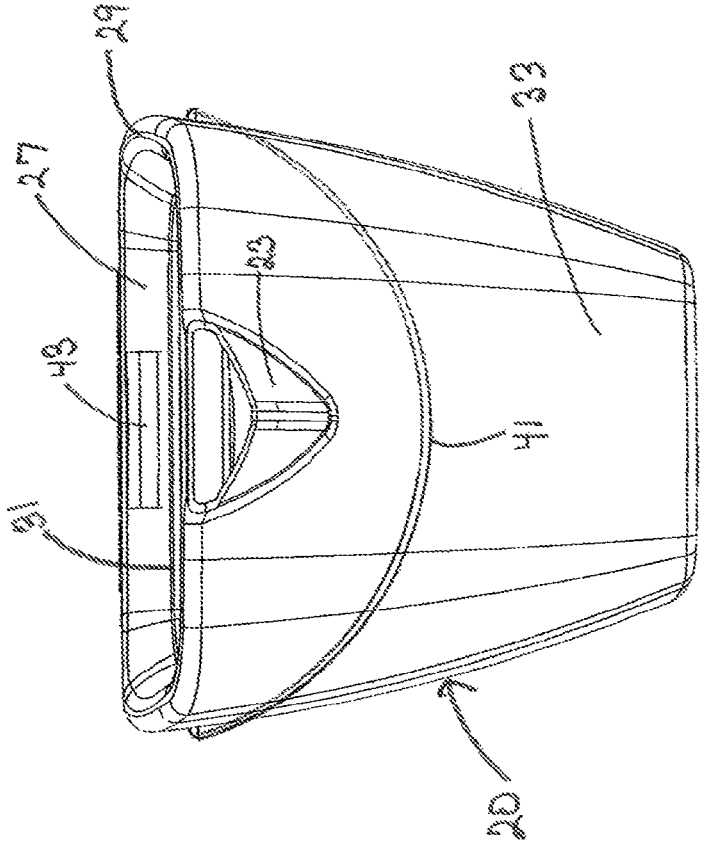
FIG. 7 is a front view of a larger container of FIG. 1 with a metal handle.

FIG. 7 is a perspective view of an embodiment of a larger container 20 with spout 23, flange 27 and a metal handle 41 to carry larger quantities of liquid or loose materials.

CONCLUSION

The present invention is a plastic molded container providing an overhanging ledge that allows a brush to be wiped away from the rim. The flange is sloped at an angle allowing liquids that get on edge to drain back into container. The edge of the flange allows a flat sided brush when loaded with liquid to be wiped leaving brush with even load of, liquids.

The flange having a magnet to hold a brush, The container having a spout to easily empty liquids or loose material, and a handle to hold container.

Although the description above contains many specificities, these should not be constructed as limiting the scope of embodiment but merely providing illustration of some of embodiments. Accordingly, departures may be made from such details without departing from the spirit and scope of the applicants general inventive concept.

I claim:

1. A container comprising:

A container body having front, back left and right sidewalls, an open top and closed bottom, the front and back sidewalls are opposite each other and the left and right sidewalls are opposite each other, the sidewalls, open top and closed bottom define a cavity for liquids or loose materials, said sidewalk are trapezoidal in shape, and slant inwards as they extends from the open top to said closed bottom allowing containers to be stacked one inside the other for convenient shipping and retail display, said sidewalls define a top rim at the open top, a continuous flange extends from the sidewalls along the entire perimeter of said top rim, said flange extends at an angle downwardly and inwardly towards the cavity from said top rim to allow liquids to drip into said container cavity, said flange terminating in an edge below and spaced radially inwardly from the top rim for wiping excess liquids off of an applicator, a magnet secured to the flange for securing an applicator at substantially the same angle as said flange thereby allowing excess liquid to drip from the applicator into the container cavity, a handle extends from one of the sidewalls which is contoured so a user can rest the container on the top of the user's hand, and a pouring spout extending outwardly from one of said sidewalls below said top rim.

* * * * *